US006153263A

United States Patent [19]

Haruta et al.

[11] Patent Number: 6,153,263

[45] Date of Patent: Nov. 28, 2000

[54] INK JET TEXTILE PRINTING AND PRINTING TEXTILE ARTICLE

[75] Inventors: Masahiro Haruta, Tokyo; Shoji Koike, Yokohama; Koromo Shirota, Kawasaki; Tomoya Yamamoto, Nara; Mariko Suzuki, Yokohama; Shinichi Hakamada, Kawasaki, all of Japan

[73] Assignee: Canon Kabushiki Kaisha, Tokyo, Japan

[21] Appl. No.: 08/812,161

[22] Filed: Mar. 6, 1997

[30] Foreign Application Priority Data

Mar. 8, 1996 [JP] Japan ..... 8-079330

[51] Int. Cl.[7] ..... B05D 1/00

[52] U.S. Cl. ..... 427/261; 427/265; 427/288; 427/285

[58] Field of Search ..... 427/261, 287, 427/288, 377, 256, 285, 265; 428/195; 101/488, 491, 493; 8/447

[56] References Cited

U.S. PATENT DOCUMENTS

| | | | |
|---|---|---|---|
| 2,371,153 | 3/1945 | Connelly . | |
| 4,094,637 | 6/1978 | Feess et al. | 8/71 |
| 4,254,520 | 3/1981 | Saurman | 8/447 |
| 5,583,553 | 12/1996 | Shirota et al. | 347/100 |

FOREIGN PATENT DOCUMENTS

| | | |
|---|---|---|
| 54-59936 | 5/1979 | Japan . |
| 63-6183 | 1/1988 | Japan . |
| 63-31494 | 2/1988 | Japan . |
| 4-35351 | 6/1992 | Japan . |

*Primary Examiner*—Fred J. Parker
*Attorney, Agent, or Firm*—Fitzpatrick, Cella, Harper & Scinto

[57] ABSTRACT

A method of performing ink jet textile printing of a fiber product involves recording the border of a recorded image with a first ink containing an antibleeding agent, recording inside the border with a second coloring ink to complete the recorded image, and coloring the recorded image with heat. A printed textile article is made from fiber product substrate, and has an image formed thereon. The image has a border of a first ink containing an antibleeding agent, and an inner region located within the border is of a second coloring ink, the image having been colored by the application of heat.

22 Claims, 2 Drawing Sheets

INK JET TEXTILE PRINTING AND PRINTING TEXTILE ARTICLE

BACKGROUND OF THE INVENTION

Field of the Invention

The present invention relates to methods of ink jet printing for performing textile printing on fiber products such as fabric using ink jet processes.

Description of the Related Art

Prior art ink jet recording processes on fabric include, for example, a textile printing method with a printer in which a fabric is temporarily adhered to the upper face of a non-stretching flat supporting member with a bonding agent (Japanese Unexamined Patent Publication No. 63-6,183); an ink jet textile printing method on a fabric which has been previously treated with an aqueous solution containing a material not having dying properties with dyes used among a water-soluble polymer, a water soluble salt and water-insoluble inorganic fine particles (Japanese Unexamined Patent Publication No. 63-31,594); and pretreatment of cellulose fiber with an aqueous solution containing an alkaline compound, urea or thiourea, and a water-soluble polymer, ink jet textile printing with an ink containing a reactive dye, and fixing with heat (Japanese Examined Patent Publication No. 4-35,351).

These prior art ink jet recording processes aim at preventing image bleeding, allowing sharp image printing, and providing deep, clear textile printing. However, these processes still do not provide printed matters having the same color density and brightness as those obtained by conventional textile printing processes such as screen textile printing. Further, since ink barely penetrates in the depth direction of the fabric, color depth and strike-through are insufficient, and bleeding occurs in cases where there is a large amount of ink loading. Accordingly, the applicable scope of the printed textile is restricted.

SUMMARY OF THE INVENTION

In accordance with one aspect of the present invention, a method of performing ink jet textile printing comprising the steps of:

recording a border of a recorded image with a first ink containing an antibleeding agent;

recording inside the border with a second coloring ink to complete the recorded image; and coloring the recorded image with heat.

Another aspect of the present invention relates to a method of performing ink jet textile printing of a fiber product comprising the steps of:

recording a border between different hue regions with a first ink containing an antibleeding agent;

recording each of the inner regions of different hues demarcated by the border with a second coloring ink to complete the recorded image; and coloring the recorded image with heat.

Another aspect of this invention relates to a printed textile article, comprising:

a fiber product substrate;

a recorded image formed on the fiber product substrate, the recorded image comprising, a border of a first ink containing an antibleeding agent; and an inner region, demarcated by the border, of a second coloring ink;

wherein the recorded image has been colored by an application of heat.

Another aspect of this invention relates to a printed textile article, comprising:

a fiber product substrate;

a recorded image formed on the fiber product substrate, the recorded image comprising, a border of a first ink containing an antibleeding agent; and patterns having different hues demarcated by the border, of the second coloring inks;

wherein the recorded image has been colored by application of heat.

DETAILED DESCRIPTION OF THE PREFERRED EMBODIMENTS

In the present invention, in order to suppress image bleeding on fiber products and to obtain a high density image with deep color, borders of the image and between different hue regions are recorded with a first ink containing an antibleeding agent against the fiber material, and then, an inner region located within each border is recorded by an ink jet process with a second coloring ink. It was found that, by recording the border of the image and the border between different hue regions with the first ink, bleeding and color mixing can be suppressed and color depth and strike-through properties can be improved regardless of the amount of the second coloring ink. Hereupon, the border of the image means the outline of the entire image formed between a color image and a non-recorded region or another color image, and a border between different hue regions mean the border between 2 hues selected from 10 hues defined in the standard color table based on JIS-Z-8721 (Japanese Industrial Standard Z-8721). In the present invention, white and black are also included in different hues.

The present invention will now be described in detail.

Figure 1:
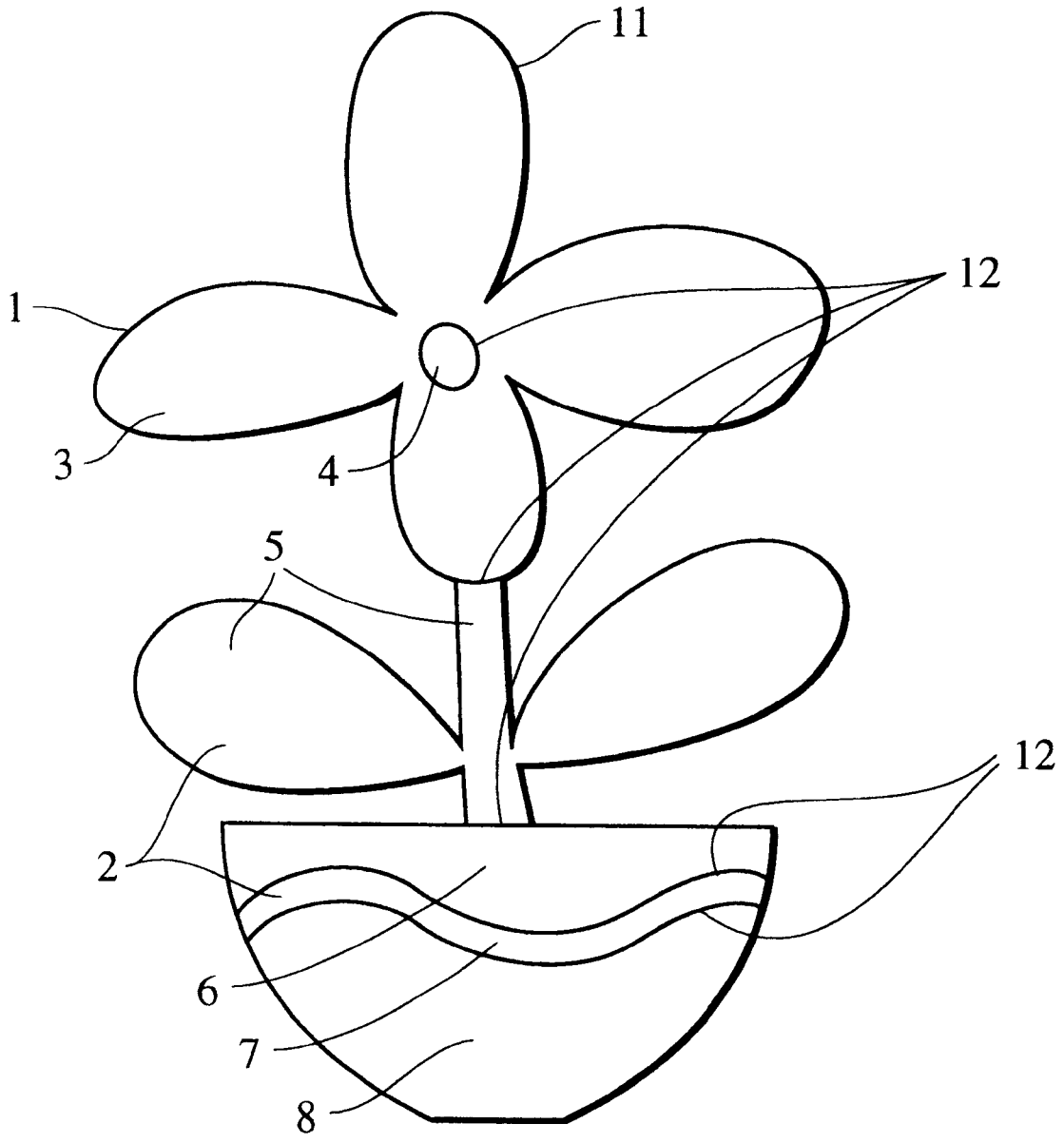
FIG. 1 is an illustration of an image produced by an ink jet printing method according to the present invention.

FIG. 1 is an illustration of an image produced by an ink jet printing method in accordance with the present invention. In FIG. 1, the border 11 of a flower image and borders 12 between different hue regions are printed on a fabric with a first ink 1 containing an antibleeding agent by ink jet recording, then color patterns which are located within these borders are printed using second coloring inks 2, for example, red ink 3, yellow ink 4, green ink 5, blue ink 6, black ink 7 and orange ink 8 again by ink jet recording. Bleeding and color mixing can be suppressed and color depth and strike-through properties can be improved regardless of the amount of the second coloring inks 2, because the border 11 of the image and the borders 12 between different hue regions are recorded with the first ink 1.

Figure 2:
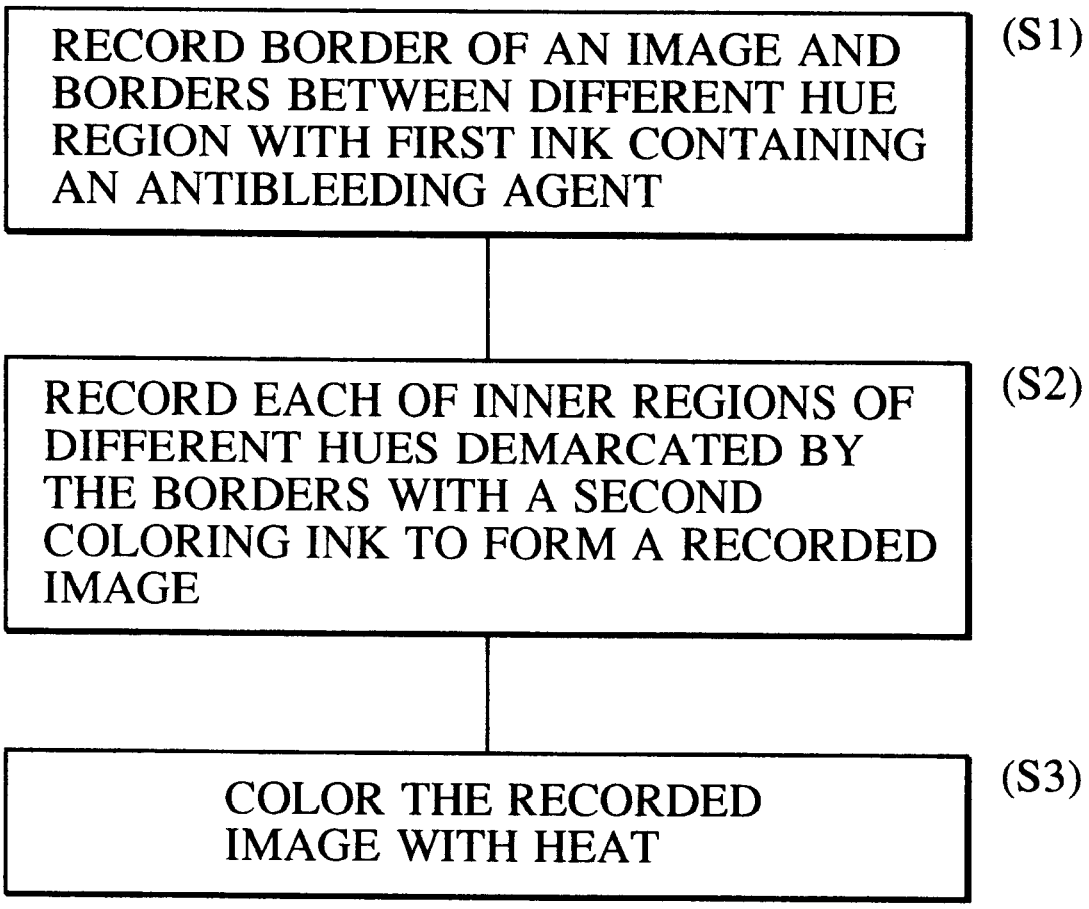
FIG. 2 is a flow chart depicting a method of performing ink jet textile printing in accordance with the invention.

Next, a method of forming a recorded image in accordance with this invention will be described with reference to FIG. 2. In step S1, the border of an image and the border between different hue regions are recorded using a first ink. The first ink contains an antibleeding agent, which is described in detail below. In step S2, recording is performed inside each pattern located in these borders using a second coloring ink to form the recorded image. Then, in step S3, the recorded image, which it will be appreciated consists of both the border and the second coloring ink inside the border, is fixed using heat.

The fiber products used in the present invention will now be described.

Examples of fiber products useful with the present invention include paper and fabrics, including non-woven fabrics. Examples of these fabrics include cotton, silk, linen, nylon, rayon, acetate and polyester and their blended yarn fabrics. The type of ink used for dyeing must be appropriate for the type of fabric. For example, cotton, silk, linen and rayon can be recorded upon using containing reactive dyes, and nylon and occasionally silk are recorded upon using inks containing acid dyes. Acetate and polyester are recorded with inks containing disperse dyes. Before fabrics of cotton and the like are dyed with reactive dyes, the fabrics must be padded with an aqueous solution of sodium carbonate or sodium bicarbonate to alkalify the fabrics.

The first ink containing an antibleeding agent, which is characteristic of the present invention, will be described.

Antibleeding agents usable in the first ink in accordance with the present invention are hydrophobic compounds which repel water. Examples of antibleeding agents include water repellents, e.g. fluorine compounds, silicone compounds, waxes, triazine compounds and their mixtures. Other examples of such antibleeding agents include metal salts, e.g. sodium chloride, sodium sulfate, calcium chloride and magnesium chloride; polymeric compounds, e.g. starch, sodium alginate, carboxymethyl cellulose, guayule, casein, polyvinyl alcohol, polyvinyl pyrrolidone, polyethyleneimine, polyarylamine, polyethylene oxide, polyacrylamide and polysodium acrylate; organic amine compounds, e.g. trimethylbenzylammonium chloride, polydiaryldimethylammonium chloride, stearyltrimethylammonium chloride, stearylamine acetate and glycine; and cationic inorganic fine particles, e.g. boehmite-type alumina sol. Among these, water repellents, polymeric compounds and organic amine compounds are preferably used.

The content of the antibleeding agent in the first ink ranges from 0.5 to 20 percent by weight and is preferably from 1.0 to 5.0 percent by weight. A content of less than 0.5 percent by weight does not give a satisfactory antibleeding effect, while the antibleeding effect is saturated, and clogging and changes in discharge characteristics occur at a content of over 20 percent by weight.

The first ink may contain an anti-clogging solvent, miscellaneous additives, deionized water and the like in addition to the antibleeding agent set forth above. A colorless ink containing an antibleeding agent can be produced by dissolving the materials set forth above.

Examples of anti-clogging agents include ethylene glycol, diethylene glycol, polyethylene glycol, thiodiglycol, propylene glycol, glycerin and pyrrolidone. The amount of the anti-clogging agent added to the first ink ranges from 5.0 to 50 percent by weight and is preferably from 5.0 to 30 percent by weight. Examples of miscellaneous additives include surfactants, e.g. polyoxyethylene alkyl ethers and polyoxyethylene alkylamines; and inorganic salts, e.g. sodium chloride and sodium sulfate. The amount of additive in the first ink ranges from 0.1 to 10 percent by weight and is preferably 0.5 to 5 percent by weight. These miscellaneous additives are used in order to improve ink discharge stability and to control ink permeability into the fiber product.

The first ink contains deionized water as an aqueous medium. The deionized water content ranges from 30 to 94 percent by weight and is preferably 60 to 90 percent by weight to the total weight of the ink.

The second coloring ink used in the present invention will be explained.

The coloring ink mainly contains a dye and an aqueous medium. A useful coloring ink contains one of reactive dyes, acid dyes, direct dyes and disperse dyes, and ink containing an optimum dye can be used according to the type of fabric used.

Non-limiting examples of dyes include reactive dyes, e.g. C.I. Reactive Yellow 15 and 42, C.I. Reactive Red 24 and 218 and C.I. Reactive Blue 38 and 220; acid dyes, e.g. C.I. Acid Yellow 142, C.I. Acid Red 24, C.I. Acid Blue 185, and C.I. Acid Black 52:1; direct dyes, e.g. C.I. Direct Yellow 86, C.I. Direct Red 80, C.I. Direct Blue 199, and C.I. Direct Black 154; and disperse dyes, e.g. C.I. Disperse Yellow 99, 126, 160 and 198, C.I. Disperse Red 135, 152 and 348, and C.I. Disperse Blue 60, 87, 165 and 257. The preferable dye content ranges from 0.5 to 20 percent by weight.

The second coloring ink contains water or deionized water as an aqueous medium. The water content ranges from 10 to 93 percent by weight and is preferably from 25 to 87 percent by weight of the ink. It is preferred that the aqueous medium contain at least one organic solvent. Examples of organic solvents include ketones and ketone alcohols, e.g. acetone and diacetone alcohol; ethers, e.g. tetrahydrofuran and dioxane; polyoxyethylene and polyoxypropylene addition polymers, e.g. diethylene glycol, triethylene glycol, tetraethylene glycol, dipropylene glycol, tripropylene glycol, polyethylene glycol and polypropylene glycol; alkylene glycols comprising alkylene units having 2 to 6 carbon atoms, e.g. ethylene glycol, propylene glycol trimethylene glycol, butylene glycol, 1.2.6-hexanetriol, and hexylene glycol; thioglycol; glycerin; lower alkyl ethers polyvalent alcohols, e.g. ethylene glycol monomethyl ether and monoethyl ether, diethylene glycol monomethyl ether and monoethyl ether, and triethylene glycol monomethyl ether and monoethyl ether; lower dialkyl ethers of polyvalent alcohols, e.g. triethylene glycol dimethyl ether and diethyl ether, and tetraethylene glycol dimethyl ether and diethyl ether; sulfolane; N-methyl-2-pyrrolidone; 1,3-dimethyl-2-imidazolidinone; and bishydroxyethylsulfone.

These organic solvents can be used alone or in combination in the aqueous medium. The preferred composition of the aqueous medium includes at least one polyvalent alcohol. In particular, thioglycol and diethylene glycol can be preferably used alone or in combination with other solvents.

The content of the water soluble organic solvent ranges from 5 to 60 percent by weight and is preferably 5 to 50 percent by weight of the ink.

The second coloring ink used in the present invention may include other known additives, e.g. viscosity modifiers, surface tension modifiers, fluorescent brighteners, antifoaming agents, pH modifying buffer solutions, mildewcides and the like, as is needed. Examples of viscosity modifiers include water-soluble polymers such as polyvinyl alcohol and cellulose. Examples of surface tension modifiers include diethanolamine and triethanolamine.

Compounds for dispersing disperse dyes include dispersants, surfactants, resins and the like. Usable dispersants and surfactants include anionic and nonionic types. Examples of anionic types include fatty acid salts, alkylsulfate ester salts, alkylbenzenesulfonate salts, alkylnaphthalenesulfonate salts, dialkylsulfosuccinate salts, alkylphosphate ester salts, formaldehyde condensates of naphthalenesulfonate, polyoxyethylenealkylsulfate ester salts, and their substituted derivatives. Examples of nonionic types include polyoxyethylene alkyl ethers, polyoxyethylene acrylphenyl ethers, polyoxyethylene fatty acid esters, sorbitan fatty acid esters, polyoxyethylene sorbitan fatty acid esters, polyoxyethylene alkylamines, glycerin fatty acid esters, oxyethylene-propylene block copolymers, and their substituted derivatives. Examples of resinous dispersants include block copolymers, random copolymers, graft copolymers and their salts which comprise at least two monomers including at least one hydrophilic monomer. Examples of such monomers include styrene, vinylnaphthalene, alkyl alcohol esters of α, β-ethylenically unsaturated carboxylic acids, acrylic acid, maleic acid, itaconic acid, fumaric acid, vinyl acetate, vinyl alcohol, vinyl pyrrolidone, acrylamide and their derivatives. It is preferred that these resins be alkaline-soluble resins which can be dissolved in an alkaline aqueous solution.

Various surfactants can be added to the ink for reasons other than dye dispersion, if necessary.

The coloring ink in accordance with the present invention can be produced with a dye, a compound dispersing the dye, a solvent, water and other additives by a known dispersion method or mixing method.

The method of ink jet printing in accordance with the present invention includes forming the border of an image and the border between different hue regions by ink jet recording with a first ink containing an antibleeding agent and forming mixed color sections comprising one or more colors by applying droplets of the second coloring ink using ink jet recording to inner regions located within these borders.

The amount of dye adhered to the colored sections ranges from 0.01 to 1 mg/cm$^2$, preferably 0.015 to 0.6 mg/cm$^2$ and more preferably 0.02 to 0.4 mg/cm$^2$. The amount can be determined by the amount of discharged ink and the observed dye concentration in the ink. Because coloring at a high density cannot be achieved with an amount of dye of less than 0.01 mg/cm$^2$, the advantages of the present invention are not revealed below that level. Applying an amount of ink over 1 mg/cm$^2$ does not provide significant benefits in density, color reproducibility and dye stability, so again, the benefits of this invention cannot be seen.

Known ink jet methods can be used for printing according to the present invention. The most effective method is a bubble jet system as shown in, for example, Japanese Unexamined Patent Publication No. 54-59,936, in which the ink absorbs thermal energy and suddenly expands, and is discharged from the nozzle by the force caused by such expansion. When a recording head having a plurality of nozzles is used, the bubble jet system has small fluctuations in the ink discharge speed which converges within 5 to 20 m/sec, and this speed is preferable for satisfactory immersion of ink droplets containing a dispersive dye after collision with fabric.

Even when printing is performed successively for long time periods using this method, no foreign material is deposited on the heater and no disconnection occurs, meaning there is stable printing operation. The preferred conditions for achieving satisfactory ink jet printing are a discharged ink droplet volume of 20 to 200 pl, a printing ink volume of 4 to 40 nl/mm$^2$, a drive frequency of 1.5 kHz or more, and a head temperature of 35 to 60° C.

The ink discharged onto the fabric in such a manner must be fixed in a thermal fixing step or the like and the unfixed pigment must be removed in a washing step. Known thermal fixing steps which are used in conventional textile printing processes, e.g. a high temperature steaming process and a thermosol process, are also applicable to the present invention. The actual conditions vary with the type of the fabric used. For example, fixing of reactive inks to dye cotton and silk is performed by a high temperature steaming process at 100 to 105° C. for 5 to 30 minutes. Fixing of dispers inks to dye polyester fabric is performed by a high temperature steaming process at 160 to 180° C. for several minutes to several dozen minutes, or by a thermosol process at 190 to 230° C. for several minutes to several dozen minutes.

A typical washing step after the thermal fixing step includes washing with water and soaping with an aqueous solution containing an alkaline material. Polyester fabric is generally washed with water, reductively washed with an aqueous solution containing an alkaline material and a hydrosulfide, and washed with water again.

EXAMPLES

The present invention will now be illustrated with reference to examples. In the examples, "parts" means "parts by weight" unless otherwise specified.

EXAMPLE 1

A dry cotton fabric having a thickness of 250 μm was prepared by impregnating it with an aqueous solution containing 2.0 weight percent of sodium carbonate (wringing rate: 80%), followed by drying. The resulting fabric was cut off to prepare an A4 size sheet. The cut sheet was subjected to printing using a commercially available ink jet color printer (Canon BJC-820J). The border of a flower pattern and borders between different hue regions set forth in FIG. 1 were formed by 3 dot printing with a first ink (A) having the following composition shown below, and containing an antibleeding agent. The inner portions located within these borders were subjected to printing with second coloring inks in response to image signals. Immediately after printing, the fabric was steam-heated at 102° C. for 8 minutes, thoroughly washed with water, and dried. A deep color high density image was printed on the cotton fabric. The density on the back side was sufficiently high.

First Ink (A)

| | |
|---|---|
| Polyarylamine hydrochloric acid salt | 3 parts |
| Diethylene glycol | 17 parts |
| Deionized water | 80 parts |

A first ink (A) containing an antibleeding agent was prepared by mixing to dissolve these components and filtering the solution with a fluoro-pore filter.

Second Coloring Inks (B)

| | |
|---|---|
| Composition of Cyan Ink: | |
| C.I. Reactive Blue 15 | 12 parts |
| Thiodiglycol | 22 parts |
| Ethylene glycol | 13 parts |
| Deionized water | 53 parts |
| Composition of Magenta Ink: | |
| C.I. Reactive Red 226 | 11 parts |
| Thiodiglycol | 22 parts |
| Diethylene glycol | 13 parts |
| Deionized water | 54 parts |

-continued

| | |
|---|---|
| Compostion of Yellow Ink: | |
| C.I. Reactive Yellow 95 | 10 parts |
| Thiodiglycol | 22 parts |
| Diethylene glycol | 13 parts |
| Deionized water | 55 parts |
| Composition of Black Ink: | |
| C.I. Reactive Black 39 | 9 parts |
| Thiodiglycol | 22 parts |
| Ethylene glycol | 13 parts |
| Deionized water | 56 parts |

Four types of the inks set forth above were prepared by mixing their respective components, adjusting their pH to 7.0 with sodium hydroxide, and filtering the solutions with fluoro-pore filters.

EXAMPLE 2

A polyester fabric roll having a thickness of 200 $\mu$m and a width of 42 cm was prepared. The roll was subjected to full-color printing using a commercially available ink jet color printer (Canon BJC-440) with inks containing disperse dyes as set forth below. The border of an image and borders between different hue regions were formed by 2 dot printing with a first ink (B) having the following composition and containing a antibleeding agent. Immediately after printing, the printed section was cut off and steam-heated at 180° C. for 5 minutes for coloring. The cut fabric was reductively washed with an alkaline solution containing a hydrosulfite, washed with water and dried. A deep color high density image was printed on the polyester fabric. No contamination was found at the white non-printed section and the resulting image was clear and sharp. The density on the back side was sufficiently high.

First Ink (B)

| | |
|---|---|
| Polyvinyl pyrrolidone | 2 parts |
| Trimethylbenzylammonium chloride | 3 parts |
| Diethylene glycol | 15 parts |
| Deionized water | 80 parts |

A first ink (B) containing an antibleeding agent was prepared by mixing to dissolve these components and filtering the solution with a fluoro-pore filter.

Second Coloring Inks (B)

| | |
|---|---|
| Composition of Cyan Ink: | |
| C.I. Disperse Blue 87 | 7 parts |
| Sodium lignin sulfonate | 2 parts |
| Thiodiglycol | 10 parts |
| Triethylene glycol | 15 parts |
| Deionized water | 66 parts |
| Composition of Magenta Ink: | |
| C.I. Disperse Red 92 | 6 parts |
| Sodium lignin sulfonate | 2 parts |
| Thiodiglycol | 10 parts |
| Triethylene glycol | 15 parts |
| Deionized water | 67 parts |
| Composition of Yellow Ink: | |
| C.I. Disperse Yellow 93 | 6 parts |
| Sodium lignin sulfonate | 2 parts |

-continued

| | |
|---|---|
| Thiodiglycol | 10 parts |
| Triethylene glycol | 15 parts |
| Deionized water | 67 parts |
| Composition of Black Ink: | |
| C.I. Disperse Black 1 | 8 parts |
| Sodium lignin sulfonate | 2 parts |
| Thiodiglycol | 10 parts |
| Triethylene glycol | 15 parts |
| Deionized water | 65 parts |

Four types of the inks set forth above were prepared by dispersively mixing their respective components with a sand grinder and filtering the solutions with fluoro-pore filters.

EXAMPLE 3

A new type of polyester fabric of 0.8 denier weight was prepared. Printing was performed using the same procedure as in Example 2. A deep color image with a high density was printed on the both sides of the polyester fabric. No contamination was found at the white non-printed section and the resulting image was clear and sharp.

EXAMPLE 4

Silk "Habutae" (a kind of woven fabric) was padded with an aqueous 1.0-wt % sodium bicarbonate solution at a wringing rate of 70%, and dried before use. The fabric was cut to A3 size sheets and printing was performed according to the same procedure as in Example 1. A deep color high density image was printed on both sides of the silk "Habutae" fabric. No contamination was found at the white non-printed section and the resulting image was clear and sharp.

EXAMPLES 5 THROUGH 8

The padded silk "Habutae" fabric sheets were subjected to a preparatory printing step with first inks, having the same composition as in Example 1 but containing antibleeding agents set forth in Table 1 instead of polyarylamine hydrochloric acid salt, an ink jet recording step, and coloring and washing steps as in Example 4. The results of the printed fabric sheets are set forth in Table 1 along with those of Comparative Example 1, which does not contain an antibleeding agent.

TABLE 1

| Sample | Antibleeding agent | Sharpness | Color density |
|---|---|---|---|
| Example 5 | Polydiaryldimethylammonium chloride (MW: 100,000) 2% | Excellent | Excellent |
| Example 6 | Polyethylene-imine (MW: 10,000) 4% | Excellent | Excellent |
| Example 7 | Stearyltrimethylammonium chloride 5% | Excellent | Excellent |
| Example 8 | Paragium SS (Trade Name, paraffinic repellent made by Ohara Paragium Chemical Co., Ltd.) | Excellent | Excellent |
| Comparative Example 1 | Not added | Unsatisfactory | Good |

(1) Sharpness:
Excellent: No bleeding and no color mixing at the image border
Unsatisfactory: Severe bleeding and color mixing at the image border
(2) Color density:
Excellent: Clear, deep color with high density
Good: Unclear, deep color with high density

Comparative Example 2

A cotton fabric was padded with an aqueous solution containing 1-wt % sodium alginate and 2-wt % sodium carbonate (wringing rate: 70%), but was not printed with the first ink (A) containing the antibleeding agent used in Example 1, followed by drying. The padded fabric was subjected to color printing using the same coloring inks as in Example 1, and post-printing treatment as in Example 1 to prepare a printed fabric. The printed fabric exhibited slightly insufficient color deepness and sharpness and insufficient strike-through as compared to the fabric in Example 1.

As set forth above, a deep color image with a high density and no bleeding can be recorded on fabrics using an ink jet printing method in accordance with the present invention. Further, the color density at the back side of the fabric is also satisfactorily high.

What is claimed is:

1. A method of performing ink jet textile printing on a fiber product comprising the steps of:

(a) recording a border of an image on the fiber product with a first ink containing an antibleeding agent with an ink-jet printer;

(b) recording inside the border with a second ink to complete the image on the fiber product with an ink-jet printer; and (c) fixing the second ink on the fiber product with heat, wherein said first ink has a content of between 0.5 and 20% by weight of said antibleeding agent.

2. A method of performing ink jet textile printing according to claim 1, wherein said fiber product is a fabric.

3. A method of performing ink jet textile printing apparatus according to claim 1, wherein said antibleeding agent comprises a water repellent.

4. A method of performing ink jet textile printing according to claim 3, wherein said water repellent is selected from fluorine compounds, silicone compounds, waxes, triazine compounds and their mixtures.

5. A method of performing ink jet textile printing according to claim 1, wherein said antibleeding agent comprises at least one of metal salts, polymeric compounds, organic amine compounds and cationic inorganic fine particles.

6. A method of performing ink jet textile printing and forming an image on a fiber product comprising the steps of:

(a) recording a border on the fiber product between different hue regions of an image with a first ink containing an antibleeding agent with an ink-jet printer;

(b) recording each of inner regions of different hues demarcated by the border on the fiber product with a second ink with an ink-jet printer to complete the image; and (c) fixing the second ink on the fiber product with heat, wherein said first ink has a content of between 0.5 and 20% by weight of said antibleeding agent.

7. A method of performing ink jet textile printing according to either of claim 1 or claim 6, wherein said first ink contains an aqueous liquid medium.

8. A method of performing ink jet textile printing according to either of claim 1 or claim 6, wherein said second ink contains a dye and an aqueous liquid medium as main components.

9. A method of ink jet textile printing according to either of claim 1 or claim 6, wherein said second ink contains a one of a reactive dye, an acidic dye, a direct dye and a disperse dye.

10. A method of performing ink jet textile printing according to either of claim 1 or claim 6, wherein said second ink is adhered to said fiber product in an amount of 0.01 to 1 $mg/cm^2$ in terms of a dye.

11. A method of performing ink jet textile printing according to either of claim 1 or claim 6, wherein said fixing step for fixing the image with heat comprises at least one of a high temperature steaming process and a thermosol process.

12. A method of ink jet textile printing according to either claim 1 or 6, wherein said method further comprises a step of washing said fiber product resulting from step (c).

13. A method of performing ink jet textile printing according to claim 8, wherein said antibleeding agent comprises a water repellent.

14. A method of performing ink jet textile printing according to claim 13, wherein said water repellent is selected from fluorine compounds, silicone compounds, waxes, triazine compounds and their mixtures.

15. A method or performing ink jet textile printing according to claim 6, wherein said antibleeding agent comprises at least one of metal salts, polymeric compounds, organic amine compounds and cationic inorganic fine particles.

16. A method of performing ink jet textile printing on a fiber product comprising the steps of:

recording a border of an image on the fiber product with a first ink containing an antibleeding agent with an ink-jet printer;

recording inner regions inside the border with a second ink with an ink-jet printer to complete the image on the fiber product; and fixing at least part of the first ink and at least part of the second ink on the fiber product so as to fix the border and the inner regions of the image on the fiber.

17. A method of performing ink jet textile printing and forming an image on a fiber product comprising the step of:

(a) recording the image by applying an ink with an ink-jet printer on an area of the fiber product, where the image is formed, and penetrating the ink into the fiber product; and (b) fixing the ink to the fiber product with heat, wherein the method further comprises a step (c) of outlining the image with a liquid containing an antibleeding agent with an ink-jet printer, and the liquid applied on the fiber product in the step (c) prevents not only the ink remaining on the fiber product, but also the ink penetrated into the fiber product from bleeding towards an outside of the area.

18. A method of performing ink jet textile printing and forming an image on a fiber product, the image containing at least two regions which are different from each other in hue, comprising the steps of:

(a) recording the image by applying inks on the respective regions with an ink-jet printer, and penetrating the inks into the fiber product; and (b) fixing the inks to the fiber product with heat, wherein the method further comprises a step (c) of outlining the respective regions with a liquid containing an antibleeding agent with an ink-jet printer, and the liquid applied on the fiber product prevents not only the ink remaining on the fiber product but also the ink penetrated into the fiber product from bleeding between the adjacent regions.

19. A process for obtaining a fiber product having an image thereon comprising the steps of:

(a) outlining the image by applying a first ink containing an anti-bleeding agent on a fiber product with an ink-jet printer;

(b) recording the image by applying a second ink with an ink-jet printer to an area on the fiber product outlined with the first ink in the step (a);

(c) fixing the second ink to the fiber product with heat; and (d) washing the fiber product resulting from the step (c) to remove the second ink unfixed to the fiber product in the step (c).

20. A process for obtaining a fiber product having an image thereon, the image containing at least two regions which are different from each other in hue, comprising the steps of:

(a) outlining each of the regions by applying a first ink containing an antibleeding agent with an ink-jet printer;

(b) recording the image by applying second inks on the respective regions of the fiber product, each of the regions being outlined with the first ink in the step (a);

(c) fixing the second inks to the fiber product with heat; and (d) washing the fiber product resulting from the step (c) to remove the second inks unfixed to the fiber product in the step (c).

21. A process for obtaining a fiber product having an image thereon, comprising the steps of:

(a) forming the image by applying an ink with an ink-jet printer on the fiber product, and penetrating the ink into the fiber product;

(b) fixing the ink to the fiber product with heat; and (c) washing the fiber product resulting from the step (b), wherein the method further comprises a step (d) of outlining the image with a liquid containing an antibleeding agent with an ink-jet printer, and the liquid applied on the fiber product in the step (a) prevents not only the ink remaining on the fiber product, but also the ink penetrated into the fiber product from bleeding towards an outside of the area.

22. A process for obtaining a fiber product having an image thereon, the image containing at least two regions which are different from each other in hue, comprising the steps of:

(a) forming the image by applying inks with an ink-jet printer on the fiber product, and penetrating the inks into the fiber product;

(b) fixing the inks to the fiber product with heat; and (c) washing the fiber product resulting from the step (b), wherein the method further comprises a step (d) of outlining the respective regions with a liquid containing an antibleeding agent with an ink-jet printer, and the liquid applied on the fiber product prevents not only the ink remaining on the fiber product, but also the ink penetrated into the fiber product from bleeding between the adjacent regions.

* * * * *

UNITED STATES PATENT AND TRADEMARK OFFICE

CERTIFICATE OF CORRECTION

PATENT NO. : 6,153,263
DATED : November 28, 2000
INVENTOR(S) : Masahiro Haruta, et al.

It is certified that error appears in the above-identified patent and that said Letters Patent is hereby corrected as shown below:

Title page,
Under [54] Title, "INK JET TEXTILE PRINTING AND PRINTING TEXTILE ARTICLE" should read -- INK JET TEXTILE PRINTING AND PRINTED TEXTILE ARTICLE --.

Column 1,
Line 1, "INK JET TEXTILE PRINTING AND PRINTING TEXTILE ARTICLE" should read -- INK JET TEXTILE PRINTING AND PRINTED TEXTILE ARTICLE --.

Column 3,
Line 13, "using" should read -- using inks --.

Column 7,
Line 28, "a" should read -- an --.

Column 9,
Line 29, "appa-" should be deleted;
Line 30, "ratus" should be deleted;
Line 61, "a one" should read -- one --.

Column 10,
Line 5, "claim 1 or 6" should read -- of claim 1 or claim 6 --;
Line 8, "claim 8" should read -- claim 6 --;
Line 14, "or" should read -- of --.

Signed and Sealed this

Eleventh Day of September, 2001

*Attest:*

Nicholas P. Godici

NICHOLAS P. GODICI
*Acting Director of the United States Patent and Trademark Office*

*Attesting Officer*